US011286744B2

(12) United States Patent
Burckhard

(10) Patent No.: US 11,286,744 B2
(45) Date of Patent: Mar. 29, 2022

(54) METHOD AND APPARATUS FOR DIVERTING LOAD WITHIN A CUT-TO-RELEASE PACKER

(71) Applicant: HALLIBURTON ENERGY SERVICES, INC., Houston, TX (US)

(72) Inventor: Shane Robert Burckhard, Sanger, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 408 days.

(21) Appl. No.: 16/322,446

(22) PCT Filed: Mar. 14, 2018

(86) PCT No.: PCT/US2018/022491
§ 371 (c)(1),
(2) Date: Jan. 31, 2019

(87) PCT Pub. No.: WO2019/177605
PCT Pub. Date: Sep. 19, 2019

(65) Prior Publication Data
US 2021/0222511 A1 Jul. 22, 2021

(51) Int. Cl.
*E21B 23/00* (2006.01)
*E21B 33/129* (2006.01)
*E21B 23/02* (2006.01)

(52) U.S. Cl.
CPC ..... *E21B 33/1292* (2013.01); *E21B 23/02* (2013.01)

(58) Field of Classification Search
CPC .... E21B 33/1292; E21B 23/02; E21B 33/129; E21B 23/06; E21B 23/00; E21B 33/13; E21B 19/00
See application file for complete search history.

(56) References Cited

U.S. PATENT DOCUMENTS

2005/0016737 A1 1/2005 Kilgore et al.
2005/0224226 A1 10/2005 Read, Jr.
2011/0155395 A1 6/2011 Hendrickson et al.
2012/0160522 A1* 6/2012 Burgos ..... E21B 33/129 166/387
2015/0267503 A1 9/2015 Foong et al.

FOREIGN PATENT DOCUMENTS

WO 2012158372 A2 11/2012

OTHER PUBLICATIONS

International Search Report and Written Opinion dated Jan. 2, 2019 in International Application No. PCT/US2018/022491.

* cited by examiner

*Primary Examiner* — Taras P Bemko
(74) *Attorney, Agent, or Firm* — McGuireWoods LLP

(57) ABSTRACT

A cut-to-release packer can include a bottom sub, a wedge assembly, a mandrel, and a load diverting snap ring. The mandrel extends within the wedge assembly. The mandrel can include a support portion with a first cross-sectional thickness and a cut zone portion with a second cross-sectional thickness less than the first cross-sectional thickness, wherein the cut zone portion is disposed between the bottom sub and the support portion. Both the mandrel and the wedge assembly can be coupled to the bottom sub. The load diverting snap ring can be engaged with the mandrel along the support portion, wherein the load diverting snap ring facilitates transfer of tensile load between the wedge assembly and the support portion of the mandrel.

20 Claims, 4 Drawing Sheets

METHOD AND APPARATUS FOR DIVERTING LOAD WITHIN A CUT-TO-RELEASE PACKER

TECHNICAL FIELD

The present description relates in general to packers, and more particularly, for example and without limitation, to methods and apparatuses for distributing a tensile load within a packer.

BACKGROUND OF THE DISCLOSURE

In the production of oil and gas in the field, it is often required seal or isolate portions of the wellbore using a packer. Packers are utilized for treating, fracturing, producing, injecting and for other purposes. In some embodiments, packers isolate a section of the wellbore, which may be above or below the packer, depending on the desired operation.

Once a particular operation, for example, fracturing a formation, has been performed, it may be desirable to unset or release the packer to remove the packer from the wellbore.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to packers, and more particularly, for example and without limitation, to methods and apparatuses for distributing a tensile load within a packer.

Packers can be unset or released to remove the packer from the wellbore. In some embodiments, a portion of the packer mandrel is cut to release the packer from the wellbore to facilitate removal of the packer. The mandrel can be cut at a cut zone to relax or release anchoring elements of the packer, such as slips. In some applications, various cutting tools are utilized to cut the mandrel at the cut zone.

As various cutting tools of varying cutting capability can be utilized in the field, the cross-sectional thickness of the cut zone is limited by the capability of the utilized cutting tool. In some applications, the cross-sectional thickness of the mandrel limits the performance envelope of the packer, for example, the maximum tensile load and the pressure rating. In some embodiments, the tensile load envelope of a packer can range from 250,000 pounds to 900,000 pounds or greater. Therefore, in some applications, the performance envelope of the packer is limited by the selection of the cutting tool.

An aspect of at least some embodiments disclosed herein is that by diverting loads within the packer, the performance envelope of the packer is not limited while allowing for a cut zone of a desired cross-sectional thickness.

Figure 1:
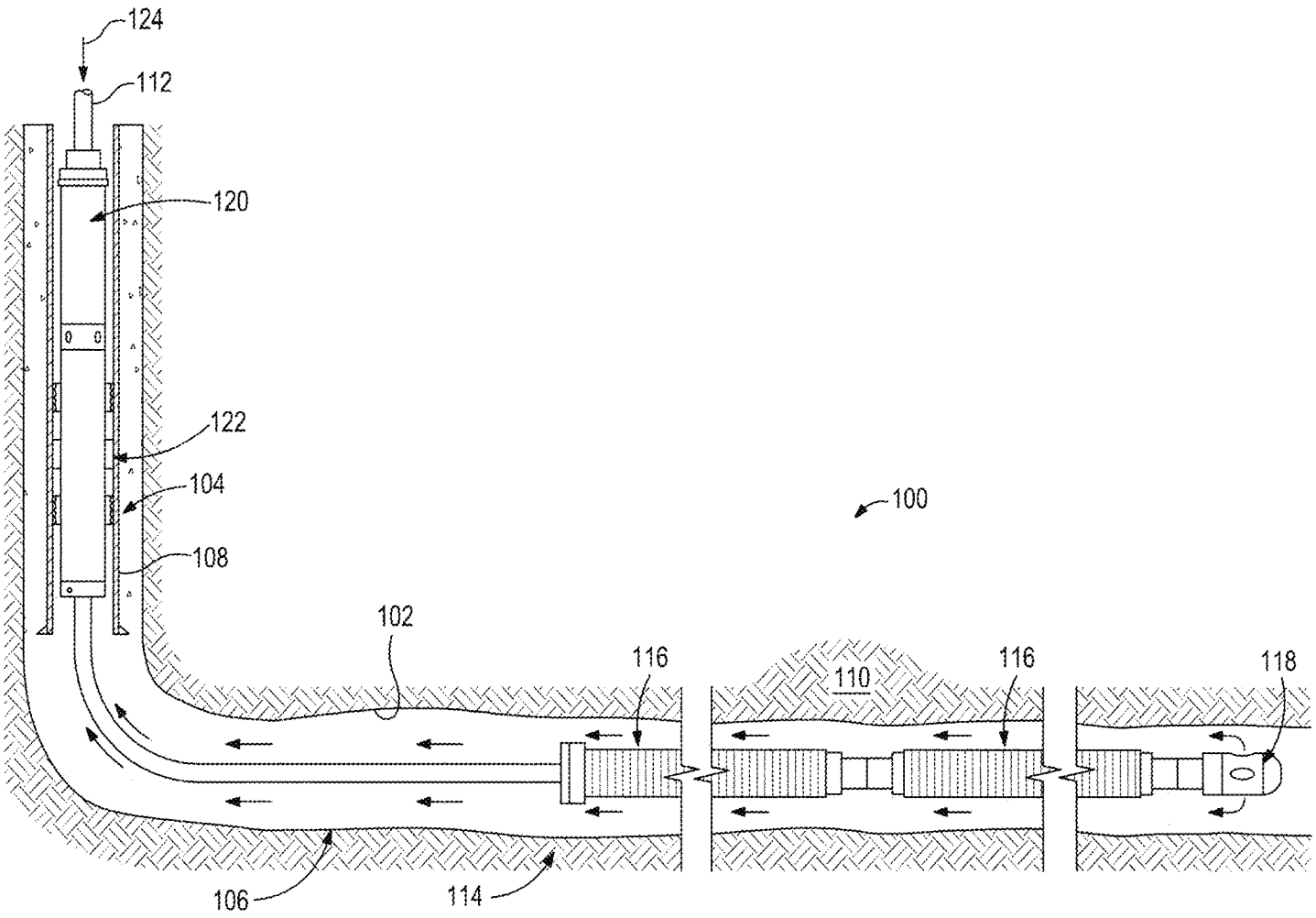
FIG. 1 is a cross-sectional view of a well system that can employ the principles of the present disclosure.

FIG. 1 is a cross-sectional view of a well system that can employ the principles of the present disclosure. As depicted, the well system 100 includes a wellbore 102 drilled through various earth strata and having a substantially vertical section 104 that transitions into a substantially horizontal section 106. At least a portion of the vertical section 104 may have a string of casing 108 cemented therein to support the wellbore 102, and the horizontal section 106 may extend through one or more hydrocarbon bearing subterranean formations 110. In the depicted example, the horizontal section 106 may comprise an open hole section of the wellbore 102. In other embodiments, however, the casing 108 may also extend into the horizontal section 106, without departing from the scope of the disclosure.

A work string 112 comprising, for example, multiple lengths of drill pipe coupled end to end is extended into the wellbore 102 from a surface location (not shown), such as the Earth's surface. A lower completion assembly 114 is secured to the lower end of the work string 112 and is arranged within the horizontal section 106. As depicted, the lower completion assembly 114 may include a plurality of sand screens 116 (two shown) axially offset from each other along portions of the lower completion assembly 114. In operation, each sand screen 116 serves the primary function of filtering particulate matter out of the production fluid stream originating from the formation 110 such that particulates and other fines are not produced to the surface. The lower completion assembly 114 terminates at a float shoe 118.

The lower completion assembly 114 is coupled to the work string 112 by a completion running tool 120 and a wellbore packer 122. The wellbore packer 122 provides a sealed interface within the wellbore 102. In some embodiments, as illustrated, the wellbore packer 122 may include compressible seal elements and radially extendible anchor slips.

As illustrated, the wellbore packer 122 can be introduced into the wellbore 102 by the completion running tool 120. The completion running tool 120 can set the wellbore packer 122 at a desired location to isolate the wellbore 120 either above or below the wellbore packer 122. In some embodiments, the completion running tool 120 can further cut a portion of the wellbore packer 122 to release the wellbore packer 122 and remove the wellbore packer 122 from the wellbore 102.

Figure 2:
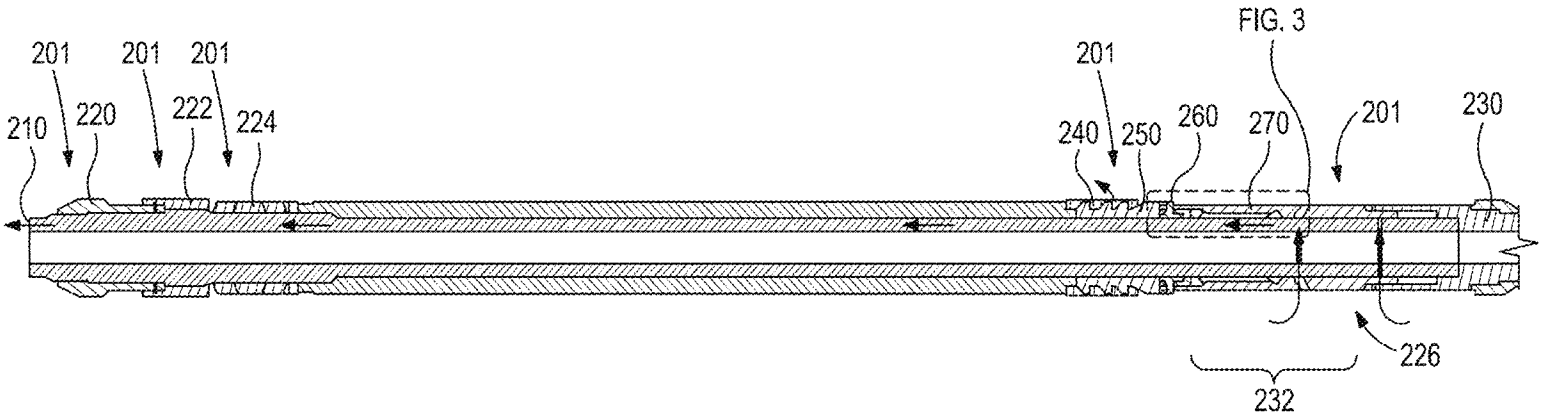
FIG. 2 is a cross-sectional view of a packer, according to some embodiments of the present disclosure.

FIG. 2 is a cross-sectional view of a packer, according to some embodiments of the present disclosure. In the depicted example, the packer 200 isolates the wellbore as previously described. Further, in addition to fluid isolation, the packer 200 can further anchor to the casing or wellbore wall and support a hang weight or tensile load attached to the packer 200. Setting the packer 200 as described herein allows the packer 200 to isolate the wellbore and support a tensile load attached thereto.

In a setting operation, tubular elements 201 of the packer 200 are moved to expand sealing or isolating members, such as the expansion member 224 and to engage anchoring members such as the barrel slip 240. As illustrated, tubular elements 201, including, but not limited to, the upper sub 200, the upper sleeve 222, the expansion member 224, the barrel slip 240, the lower wedge 250, and the retainer 260 are disposed around a mandrel 210. The tubular elements 201 can move or compress relative to the mandrel 210. Further, the tubular elements 201 can be generally concentric to the mandrel 201.

In some embodiments, by applying a compressive force to the tubular elements 201, the expansion member 224 and the barrel slip 240 can expand, thereby setting the packer 200. Referring still to FIG. 2, the tubular elements 201 are compressed around the mandrel 210. Some elements, such as the expansion member 224 can include geometry that permits expansion under compression. Other elements, such as the barrel slip 240 can interface with a ramp surface of a wedge, such as lower wedge 250 to expand. In the depicted example, as an inner surface of the barrel slip 240 is driven to engage with the ramp surface of the lower wedge 250, the barrel slip 240 expands and engages the wellbore or casing.

To compress the tubular elements 201, the mandrel 210 is pulled upward under tension, while the upper sub 220 is held stationary. As illustrated, the bottom sub 230 is coupled to the mandrel 220 and moves upward relative to the upper sub 220. Further, a tubular anchor sleeve 270 coupled to the bottom sub 230 also moves upward relative to the upper sub 220 to compress the tubular elements 201 between the upper sub 220 and the anchor sleeve 270. Alternatively, the mandrel 210 is held stationary and the upper sub 220 is pushed downward to compress the tubular elements 201 between the upper sub 220 and the anchor sleeve 270.

In the depicted example, the tubular elements 201 are compressed between the upper sub 220 and the anchor sleeve 270 to expand the expansion member 224 and to anchor the barrel slip 240. The mandrel 210 can be pulled or the upper sub 220 can be pushed relative to the tubular elements 201 to set the packer using hydraulic setting tools, hydrostatic setting tools, or mechanical setting tools. The running tool can incorporate a setting tool.

After setting, the packer 200 isolates annular fluid flow thereacross and is anchored to the wellbore or casing to prevent movement thereof and to support the hanging weight of any components coupled thereto. As illustrated, wellbore components are coupled to the bottom sub 230 of the packer 200. As previously described, as the mandrel 210 and the anchor sleeve 270 are both coupled to the bottom sub 230, both the mandrel 210 and the anchor sleeve 270 can collectively support the tensile load or hang weight form the bottom sub 230. For example, the mandrel 210 and the anchor sleeve 270 can collectively or combine to support a totality of the tensile load, which may otherwise exceed the tensile strength of portions of the mandrel 210 or the anchor sleeve 270 individually, as discussed herein. In the depicted example, the anchor sleeve 270, the retainer 260, and the lower wedge 250 can be coupled together to form a wedge assembly 232, wherein the wedge assembly 232 supports a portion of the tensile load or hang weight of the bottom sub 230.

Figure 3:
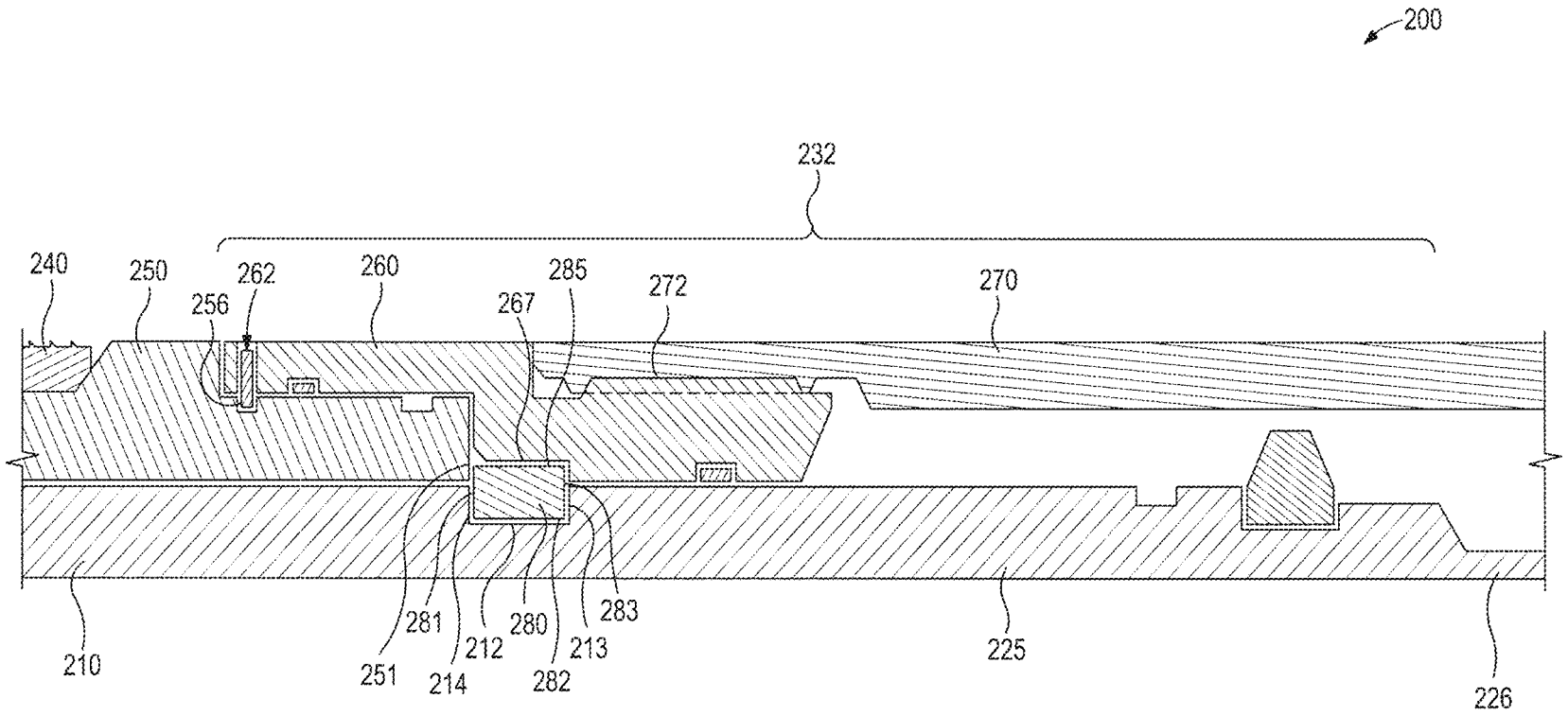
FIG. 3 is a detail cross-sectional view of the wedge assembly of the packer of FIG. 2, in a set position, according to some embodiments of the present disclosure.

FIG. 3 is a detail cross-sectional view of the wedge assembly of the packer of FIG. 2, in a set position, according to some embodiments of the present disclosure. In the depicted example, the hang weight from the bottom sub is distributed between or collectively supported by the wedge assembly 232 and the mandrel 210.

Still referring to FIG. 3, the mandrel 210 supports a portion of the hang weight or tensile load from the bottom sub. A portion of the tensile load from the bottom sub is carried by the mandrel 210 and transferred to anchoring devices coupled thereto. Geometric characteristics of the mandrel 210, for example, the wall or cross-sectional thickness of the mandrel 210 generally determines the tensile load capability thereof. In the depicted example, the support portion 225 of the mandrel 210 has a first cross-sectional thickness to meet a desired tensile load envelope.

In some embodiments, the mandrel 210 includes a cut zone 226 with a reduced cross-sectional thickness compared to the cross-sectional thickness of the support portion 225. The cross-sectional thickness of the cut zone 226 facilitates ease of cutting by suitable cutting tools including third party cutting tools.

As described herein, the total tensile load can be distributed between or collectively supported by the reduced cross-sectional area of the cut zone 226 and the wedge assembly 232. Advantageously, by distributing the tensile load between the cut zone 226 and wedge assembly 232, the tensile and pressure performance envelope of the mandrel 210 may not be limited by the cross-sectional area of the cut zone 226.

The wedge assembly 232 can support a portion of the hang weight or tensile load from the bottom sub. Further, the wedge assembly 232 transfers a tensile load from the bottom sub to the support portion 225 of the mandrel 210, allowing a portion of the tensile load to bypass the cut zone 226. As can be appreciated, the wedge assembly 232 and portions thereof, can be utilized with any suitable type of cut to release packer, including, but not limited to mechanically, hydraulically, and/or hydrostatically set packers.

In the depicted example, tensile load or hang weight of the bottom sub is supported by the anchor sleeve 270 of the wedge assembly 232. In some embodiments, the anchor sleeve 270 is fixedly coupled to the retainer 260, transferring the load thereto. The anchor sleeve 270 can include a threaded coupling 272 to the retainer 260.

As illustrated, the retainer 260 and the lower wedge 250 are releasably coupled by a shear device 262, such as a shear pin, that passes through the retainer 260 into a shear device groove 256 of the lower wedge 250. Therefore, a portion of the total tensile load from the retainer 260 is transferred to the lower wedge 250 until a critical load value is exceeded. In the depicted example, the shear device 262 can withstand a partial hang weight of the bottom sub and may be configured to be shorn and release the coupling between the retainer 260 and the lower wedge 250 if subjected to the entire hang weight of the bottom sub. Thus, when the critical load value is exceeded, the shear pin is shorn, and the retainer 260 can slide relative to the lower wedge 250.

Referring still to FIG. 3, when the packer 200 is in a set position, with the snap ring 280 is in its compressed state (and the shear device 262 and the cut zone 226 being intact), the lower surface 251 of the lower wedge 250 engages the upper surface 281 of the load diverting snap ring 280 to transfer the tensile load to the load diverting snap ring 280. The load diverting snap ring 280 is disposed within the support portion 225 of the mandrel 210. Thus, the lower surface 283 of the load diverting snap ring 280 engages the lower surface 213 of the support groove 212. Accordingly, part of the hang weight or tensile load from the bottom sub is diverted from the cut zone 226 through the wedge assembly 232 and directed to the support portion 225 of the mandrel 210 via the snap ring 280.

In the depicted example, to maintain the packer 200 in a set configuration, the load diverting snap ring 280 is retained within the support groove 212 to prevent the inadvertent release of the barrel sip 240. Further, the retainer 260 retains the load diverting snap ring 280 within the support groove 212. Optionally, the load diverting snap ring 280 is outwardly biased. The retainer 260 can retain the outwardly biased load diverting snap ring 280 within the support groove 212.

Therefore, a retention surface 268 of the retainer 260 is adjacent to an outer surface 285 of the load diverting snap ring 280 to prevent the expansion of the load diverting snap ring 280 until desired.

Figure 4:
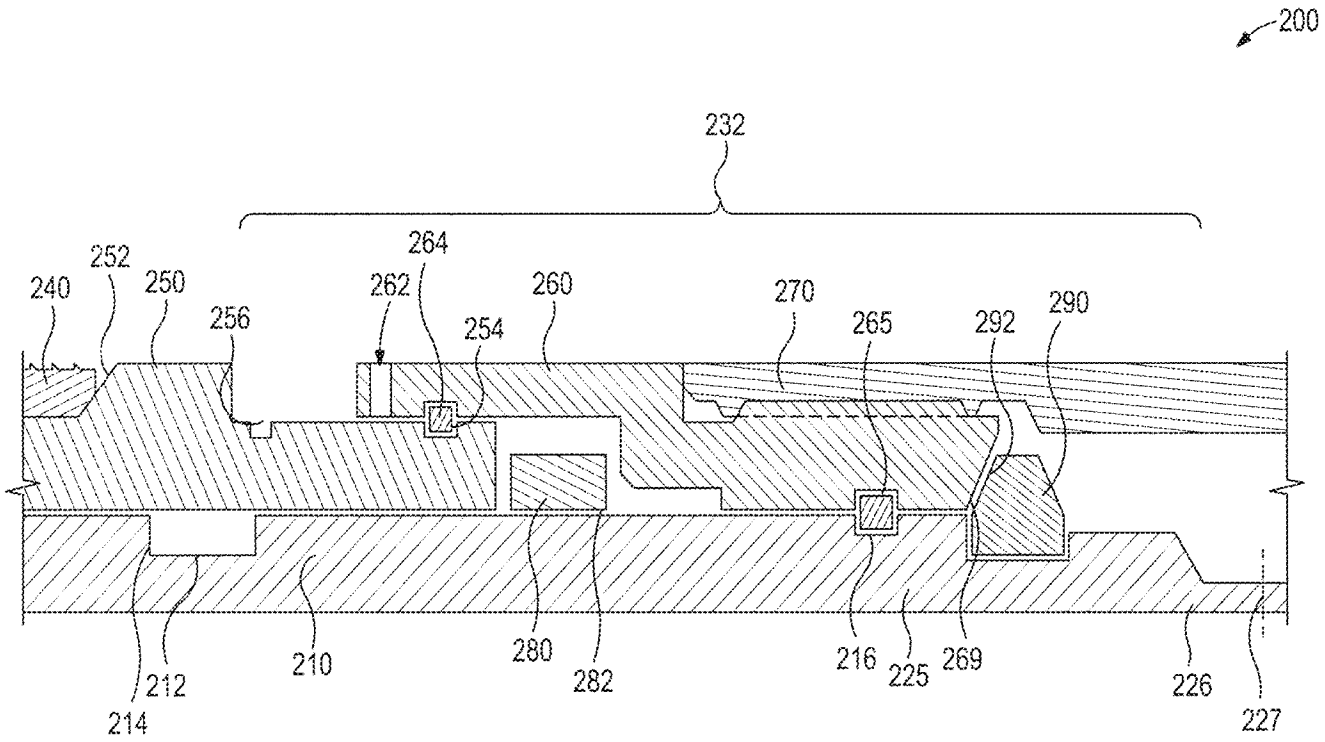
FIG. 4 is a detail cross-sectional view of the wedge assembly of FIG. 3 in a released position, according to some embodiments of the present disclosure.

The packer 200 may be released and removed upon completion of a desired operation. Advantageously, in order to release the packer 200, the operator must only cut through the cut zone 226 (which can be much thinner than in a traditional packer). FIG. 4 is a detail cross-sectional view of the wedge assembly of FIG. 3 in a released position, according to some embodiments of the present disclosure. To release the packer 200, the packer mandrel 210 is cut along a cut line 227 within the cut zone 226. Any suitable cutting device can be used. For example, cutting devices such as a mechanical pipe cutter, a cutting torch, a milling device, etc., can be used. Advantageously, the cut zone 226 cross-sectional thickness allows for flexibility in determining the cutting tool to be used while permitting a desired performance envelope. For example, the cut zone 226 cross-sectional thickness can be selected based on the capabilities of a selected cutting tool while the packer 200 can still support a desired tensile load. Further, the tensile load and pressure envelope of the packer 200 does not need to be reduced to facilitate the use of various cutting tools.

After the cut zone 226 of the mandrel 210 is cut, the tensile load from the bottom sub is immediately supported only by the wedge assembly 232. As a result, the tensile load increases the shear force on the shear device 262 until the shear device 262 is shorn. Thereafter, the continued tensile force supported by the anchor sleeve 270 will cause the retainer 260 to slide downhole relative to the lower wedge 250, translating the retainer 260 and the anchor sleeve 270 downhole.

In the depicted example, as the retainer 260 and the anchor sleeve 270 move downward from the hang weight, the retention surface 268 of the retainer 260 slides relative to the outer surface 285 of the load diverting snap ring 280 until the retention surface 268 no longer constrains expansion of the snap ring 280. When the retention surface 268 is clear of the snap ring 280, the load diverting snap ring 280 is allowed to expand radially outwardly. In some embodiments, the inner diameter 282 of the load diverting snap ring 280 is greater than the height 214 of the support groove 212, thereby releasing the load diverting snap ring 280 from the support groove 212. The load diverting snap ring 280 may be free to move longitudinally along the mandrel 210 (e.g., downhole relative to the mandrel 210).

In the depicted example, after the load diverting snap ring 280 is released, the snap ring 280 expands radially outwardly to exit the support groove 212. When this happens, the snap ring 280 no longer acts to resist motion of the lower wedge 250 relative to the mandrel 210. Thus, motion of the lower wedge 250 is no longer constrained by the load diverting snap ring 280. Therefore, as the lower wedge 250 slides downhole relative to the mandrel 210, the barrel slip 240 (which can be biased toward a radially collapsed state) can move relative to the ramp surface 252 of the lower wedge 250 to radially contract and disengage from the wellbore wall or the casing, thereby releasing the packer 200.

Further, in order to ensure that the bottom sub, the retainer 260, and the anchor sleeve 270 remain coupled to the packer 200, as the retainer 260 continues downward, the lower surface 269 of the retainer 260 can engage the upper surface 292 of the pick-up ring 290 to limit axial travel of the wedge assembly 232. The pick-up ring 292 can further prevent the wedge assembly 232 from traveling downhole beyond the packer 200. As the released packer 200 is retrieved, the pick-up ring 290 can engage and retrieve the wedge assembly 232 with the remainder of the released packer 200.

Optionally, the packer 200 can also comprise an anti-reset mechanism to prevent reengagement of the barrel slip 240 (through uphole motion of the wedge assembly 232 relative to the mandrel 210) as the packer 200 is retrieved. An upper anti-reset snap ring 264 and a lower anti-reset snap ring 265 can be housed within the retainer 260. As the wedge assembly 232 moves downhole relative to the mandrel 210, both of the upper anti-reset snap ring 264 and the lower anti-reset snap ring 265 can fix the lower wedge 250 relative to the retainer 260 and the mandrel 210 to prevent movement of the lower wedge 250 relative to the barrel slip 240 to thereby prevent re-engagement of the barrel slip 240 with the wellbore wall or the casing.

The upper anti-reset snap ring 264 and the lower anti-reset snap ring 265 can be radially inwardly biased snap rings. Prior to engaging respective upper and lower anti-reset grooves 254, 216, the upper anti-reset snap ring 264 and the lower anti-reset snap ring 265 can be in an expanded state and slide along the outer surface of the mandrel 210. When longitudinally traversing the grooves 254, 216, the upper anti-reset snap ring 264 and the lower anti-reset snap ring 265 can be biased to contract into engagement with the respective grooves 254, 216. When traversing the groove 254, the upper anti-reset snap ring 264 is biased inwardly to engage the upper anti-reset groove 254 within the lower wedge 250, thereby locking or fixing the retainer 260 relative to the lower wedge 250. Further, when traversing the groove 216, the lower anti-reset snap ring 265 is biased inwardly to engage the lower anti-reset groove 216 within the mandrel 210, thereby locking or fixing the retainer 260 relative to the mandrel 210.

Various examples of aspects of the disclosure are described below as clauses for convenience. These are provided as examples, and do not limit the subject technology.

Clause 1. A cut-to-release packer comprising: a bottom sub configured to be coupled with a completion device; a wedge assembly having a downhole end portion coupled to the bottom sub; a mandrel extending within the wedge assembly and being coupled to the bottom sub, the mandrel including a support portion with a first cross-sectional thickness and a cut zone portion with a second cross-sectional thickness less than the first cross-sectional thickness, wherein the cut zone portion is disposed between the bottom sub and the support portion; and a load diverting snap ring engaged with the mandrel along the support portion, wherein the load diverting snap ring facilitates transfer of tensile load between the wedge assembly and the support portion of the mandrel.

Clause 2. The cut-to-release packer of Clause 1, wherein the wedge assembly comprises a lower wedge and an anchor sleeve coupled to the lower wedge.

Clause 3. The cut-to-release packer of Clause 2, wherein in a set position, the lower wedge is positioned longitudinally adjacent to the load diverting snap ring for contacting the load diverting snap ring to facilitate transfer the tensile load from the anchor sleeve to the support portion of the mandrel.

Clause 4. The cut-to-release packer of Clause 2, wherein an upper surface of the load diverting snap ring engages the lower wedge.

Clause 5. The cut-to-release packer of any preceding clause, wherein the wedge assembly further comprises a retainer coupled to an anchor sleeve and releasably coupled to a lower wedge.

Clause 6. The cut-to-release packer of Clause 5, wherein the load diverting snap ring is disposed longitudinally within the retainer in a set position.

Clause 7. The cut-to-release packer of Clause 5, wherein the retainer is threadedly coupled to the anchor sleeve.

Clause 8. The cut-to-release packer of Clause 5, further comprising a shear device releasably coupling the retainer to the anchor sleeve.

Clause 9. The cut-to-release packer of Clause 5, further comprising a pick-up ring engaged with the mandrel along the support portion and adjacent to the cut zone portion, wherein the retainer engages the pick-up ring to limit an axial travel of the retainer in a released position.

Clause 10. The cut-to-release packer of any preceding clause, further comprising a support groove formed in the support portion of the mandrel, wherein a lower surface of the load diverting snap ring engages against the support groove in a set position.

Clause 11. The cut-to-release packer of Clause 10, wherein the wedge assembly further comprises a retainer that engages against an outer surface of the load diverting snap ring to retain the load diverting snap ring within the support groove in the set position.

Clause 12. The cut-to-release packer of Clause 10, wherein the load diverting snap ring is radially outwardly biased.

Clause 13. The cut-to-release packer of any preceding clause, further comprising a barrel slip disposed around the wedge assembly, wherein the wedge assembly engages an inner surface of the barrel slip to radially expand the barrel slip in a set position.

Clause 14. The cut-to-release packer of Clause 13, wherein a ramp surface of the wedge assembly engages the inner surface of the barrel slip.

Clause 15. A method to release a packer, the method comprising: distributing a total tensile load from a bottom sub between a mandrel and a wedge assembly both coupled to the bottom sub, wherein the wedge assembly supports a portion of the total tensile load; cutting the mandrel at a cut zone portion of the mandrel; and translating the wedge assembly downward to release a barrel slip disposed around the mandrel.

Clause 16. The method of Clause 15, wherein the mandrel includes a support portion with a first cross-sectional thickness and the cut zone portion includes a second cross-sectional thickness less than the first cross-sectional thickness.

Clause 17. The method of Clauses 15 or 16, wherein the mandrel extends within the wedge assembly.

Clause 18. The method of Clause 17, further comprising diverting the portion of the total tensile load from the wedge assembly to a support portion of the mandrel.

Clause 19. The method of Clauses 15-18, further comprising engaging the barrel slip with the wedge assembly, wherein the wedge assembly engages an inner surface of the barrel slip to expand the barrel slip.

Clause 20. The method of Clauses 15-19, wherein the wedge assembly comprises a retainer releasably coupling an anchor sleeve to a lower wedge.

Clause 21. The method of Clause 20, further comprising releasing the anchor sleeve from the lower wedge based on the wedge assembly receiving the total tensile load.

Clause 22. The method of Clause 21, further comprising releasing the lower wedge from the barrel slip to release the packer.

Clause 23. The method of Clauses 15-22, further comprising retrieving the packer.

Clause 24. The method of Clauses 15-23, further comprising limiting a release travel of the wedge assembly.

Clause 25. The method of Clauses 15-24, further comprising limiting uphole travel of the wedge assembly to prevent reengagement of the barrel slip.

Clause 26. A cut-to-release packer comprising: a bottom sub configured to be coupled with a completion device; a wedge assembly including: an anchor sleeve coupled to the bottom sub; a lower wedge coupled to the anchor sleeve; and a retainer coupled to the anchor sleeve and releasably coupled to the lower wedge; a mandrel extending within the wedge assembly and being coupled to the bottom sub, the mandrel including a support portion with a first cross-sectional thickness and a cut zone portion with a second cross-sectional thickness less than the first cross-sectional thickness, wherein the cut zone portion is disposed between the bottom sub and the support portion; and a load diverting snap ring engaged with the mandrel along the support portion, wherein the load diverting snap ring facilitates transfer of tensile load between the lower wedge and the support portion of the mandrel.

Clause 27. The cut-to-release packer of Clause 26, wherein an upper surface of the load diverting snap ring engages the lower wedge.

Clause 28. The cut-to-release packer of Clauses 26 or 27, further comprising a support groove formed in the support portion of the mandrel, wherein a lower surface of the load diverting snap ring engages against the support groove.

Clause 29. The cut-to-release packer of Clause 28, wherein the load diverting snap ring is disposed longitudinally within the retainer in a set position.

Clause 30. The cut-to-release packer of Clauses 26-29, wherein the load diverting snap ring is radially outwardly biased.

Clause 31. The cut-to-release packer of Clauses 26-30, wherein the retainer is threadedly coupled to the anchor sleeve.

Clause 32. The cut-to-release packer of Clauses 26-31, further comprising a shear device releasably coupling the retainer to the anchor sleeve.

Clause 33. The cut-to-release packer of Clauses 26-32, further comprising a pick-up ring engaged with the mandrel along the support portion and adjacent to the cut zone portion, wherein the retainer engages the pick-up ring to limit an axial travel of the retainer in a released position.

Clause 34. The cut-to-release packer of Clauses 26-33, further comprising a barrel slip disposed around the lower wedge, wherein the lower wedge engages an inner surface of the barrel slip to radially expand the barrel slip in a set position.

Clause 35. The cut-to-release packer of Clause 34, wherein a ramp surface of the lower wedge engages the inner surface of the barrel slip.

Clause 36. A method to release a packer, the method comprising: distributing a total tensile load from a bottom sub between a mandrel and an anchor sleeve both coupled to the bottom sub, wherein the anchor sleeve supports a portion of the total tensile load; engaging a barrel slip disposed around the mandrel with a lower wedge disposed around the mandrel, wherein the lower wedge engages an inner surface of the barrel slip to expand the barrel slip, wherein a retainer releasably couples the anchor sleeve to the lower wedge; cutting the mandrel at a cut zone portion of the mandrel; and translating the anchor sleeve downward to release the barrel slip.

Clause 37. The method of Clause 36, wherein the mandrel includes a support portion with a first cross-sectional thickness and the cut zone portion includes a second cross-sectional thickness less than the first cross-sectional thickness.

Clause 38. The method of Clause 37, wherein the anchor sleeve is disposed around the mandrel and extends from the bottom sub to the support portion.

Clause 39. The method of Clause 37, further comprising diverting the portion of the total tensile load from the anchor sleeve to the support portion of the mandrel.

Clause 40. The method of Clauses 36-39, further comprising releasing the anchor sleeve from the lower wedge based on the anchor sleeve receiving the total tensile load.

Clause 41. The method of Clauses 36-40, further comprising releasing the lower wedge from the barrel slip to release the packer.

Clause 42. The method of Clauses 36-41, further comprising retrieving the packer.

Clause 43. The method of Clauses 36-42, further comprising limiting a release travel of the anchor sleeve.

Clause 44. The method of Clauses 36-43, further comprising limiting uphole travel of the lower wedge to prevent reengagement of the barrel slip.

What is claimed is:

1. A cut-to-release packer comprising:

a bottom sub configured to be coupled with a completion device;

a wedge assembly having a downhole end portion coupled to the bottom sub; wherein the wedge assembly further comprises a retainer coupled to an anchor sleeve and releasably coupled to a lower wedge;

a mandrel extending within the wedge assembly and being coupled to the bottom sub, the mandrel including a support portion with a first cross-sectional thickness and a cut zone portion with a second cross-sectional thickness less than the first cross-sectional thickness, wherein the cut zone portion is disposed between the bottom sub and the support portion; and a load diverting snap ring engaged with the mandrel along the support portion, wherein the load diverting snap ring facilitates transfer of tensile load between the wedge assembly and the support portion of the mandrel.

2. The cut-to-release packer of claim 1, wherein the wedge assembly comprises a lower wedge and an anchor sleeve coupled to the lower wedge.

3. The cut-to-release packer of claim 2, wherein in a set position, the lower wedge is positioned longitudinally adjacent to the load diverting snap ring for contacting the load diverting snap ring to facilitate transfer the tensile load from the anchor sleeve to the support portion of the mandrel.

4. The cut-to-release packer of claim 2, wherein an upper surface of the load diverting snap ring engages the lower wedge.

5. The cut-to-release packer of claim 1, wherein the load diverting snap ring is disposed longitudinally within the retainer in a set position.

6. The cut-to-release packer of claim 1, further comprising a shear device releasably coupling the retainer to the anchor sleeve.

7. The cut-to-release packer of claim 1, further comprising a pick-up ring engaged with the mandrel along the support portion and adjacent to the cut zone portion, wherein the retainer engages the pick-up ring to limit an axial travel of the retainer in a released position.

8. The cut-to-release packer of claim 1, further comprising a support groove formed in the support portion of the mandrel, wherein a lower surface of the load diverting snap ring engages against the support groove in a set position.

9. The cut-to-release packer of claim 8, wherein the wedge assembly further comprises a retainer that engages against an outer surface of the load diverting snap ring to retain the load diverting snap ring within the support groove in the set position.

10. The cut-to-release packer of claim 1, further comprising a barrel slip disposed around the wedge assembly, wherein the wedge assembly engages an inner surface of the barrel slip to radially expand the barrel slip in a set position.

11. The cut-to-release packer of claim 10, wherein a ramp surface of the wedge assembly engages the inner surface of the barrel slip.

12. A method to release a packer, the method comprising:

distributing a total tensile load from a bottom sub between a mandrel and a wedge assembly, the mandrel and the wedge assembly both being coupled to the bottom sub, wherein the wedge assembly supports a portion of the total tensile load, wherein the wedge assembly comprises a retainer releasably coupling an anchor sleeve to a lower wedge;

cutting the mandrel at a cut zone portion of the mandrel; and translating the wedge assembly downward relative to the mandrel to release a barrel slip disposed around the mandrel.

13. The method of claim 12, wherein the mandrel extends within the wedge assembly.

14. The method of claim 13, further comprising diverting the portion of the total tensile load from the wedge assembly to a support portion of the mandrel.

15. The method of claim 12, further comprising engaging the barrel slip with the wedge assembly, wherein the wedge assembly engages an inner surface of the barrel slip to expand the barrel slip.

16. The method of claim 12, further comprising releasing the anchor sleeve from the lower wedge based on the wedge assembly receiving the total tensile load.

17. The method of claim 16, further comprising releasing the lower wedge from the barrel slip to release the packer.

18. A cut-to-release packer comprising:

a bottom sub configured to be coupled with a completion device;

a wedge assembly including:

an anchor sleeve coupled to the bottom sub;

a lower wedge coupled to the anchor sleeve; and a retainer coupled to the anchor sleeve and releasably coupled to the lower wedge;

a mandrel extending within the wedge assembly and being coupled to the bottom sub, the mandrel including a support portion with a first cross-sectional thickness and a cut zone portion with a second cross-sectional thickness less than the first cross-sectional thickness, wherein the cut zone portion is disposed between the bottom sub and the support portion; and a load diverting snap ring engaged with the mandrel along the support portion, wherein the load diverting snap ring facilitates transfer of tensile load between the lower wedge and the support portion of the mandrel.

19. The cut-to-release packer of claim 18, wherein in a set position, the lower wedge is positioned longitudinally adjacent to the load diverting snap ring for contacting the load diverting snap ring to facilitate transfer the tensile load from the anchor sleeve to the support portion of the mandrel.

20. The cut-to-release packer of claim 18, wherein an upper surface of the load diverting snap ring engages the lower wedge.

* * * * *